US009422130B1

(12) United States Patent
Varadharajan et al.

(10) Patent No.: US 9,422,130 B1
(45) Date of Patent: Aug. 23, 2016

(54) PIVOTED BELT CLAMP TO ALIGN WITH BELT TWIST DURING LINEAR MOTION IN PRINT JOB FINISHER

(71) Applicant: XEROX CORPORATION, Norwalk, CT (US)

(72) Inventors: Pravin Raj Varadharajan, Tamil Nadu (IN); Maheswaran Arunachalam, Tamil Nadu (IN)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/713,227

(22) Filed: May 15, 2015

(51) Int. Cl.
*B65H 31/34* (2006.01)
*B65H 31/38* (2006.01)

(52) U.S. Cl.
CPC ..... *B65H 31/34* (2013.01); *B65H 31/38* (2013.01); *B65H 2403/20* (2013.01)

(58) Field of Classification Search
CPC ..... B65H 31/34; B65H 31/38; B65H 9/00; B65H 2403/20
USPC ..... 271/221, 241
See application file for complete search history.

(56) References Cited

U.S. PATENT DOCUMENTS

2006/0255532 A1* 11/2006 Tsai ..... B65H 1/04 271/171
2012/0153556 A1* 6/2012 Sugiyama ..... B65H 31/3081 270/58.08
2012/0169005 A1* 7/2012 Borsuk ..... B42C 1/125 270/58.11
2012/0299239 A1* 11/2012 Wang ..... G03G 15/6538 271/227

* cited by examiner

*Primary Examiner* — David H Bollinger
(74) *Attorney, Agent, or Firm* — Ronald E. Prass, Jr.; Prass LLP

(57) ABSTRACT

A sheet stack aligning mechanism for a print job finishing machine is provided. The mechanism includes a belt driven in a reciprocating motion; a stationary rod having a longitudinal direction; a sheet stack alignment tamper that tamps a stack of sheets into alignment; and a belt clamp. The belt clamp has a main body attached to the sheet stack alignment tamper, a pivot pin, a belt attachment portion pivotably attached to the main body by the pivot pin, the belt attachment portion being fixed to the belt such that it does not move relative to the belt, and a bushing portion fixed to the main body and slidably attached to the rod. The pivot pin permits the belt attachment portion to follow a movement of the belt in a direction non-parallel to the longitudinal direction while the main body moves only in the longitudinal direction of the rod.

16 Claims, 4 Drawing Sheets

PIVOTED BELT CLAMP TO ALIGN WITH BELT TWIST DURING LINEAR MOTION IN PRINT JOB FINISHER

BACKGROUND

Disclosed herein are systems that improve the operation of print job finisher machines.

Embodiments of the disclosure are well suited for the paper stack alignment portion of a print job finisher machine.

SUMMARY

Some printing/copying systems include a finisher that performs one or more finishing operations such as, for example, stapling or other binding. Some of these finishers have an alignment function that aligns a stack of sheets of media before stapling or other binding. Alignment mechanisms can use one or more tampers to tamp the stack into alignment. Such a tamper can be attached to a belt that reciprocates to bring the tamper into contact with the stack. The tamper can also be slidingly attached by way of bushings to a stationary rod such that movement of the tamper is constrained to a linear movement as the belt moves a tamper body to which the tamper is attached. The belt can twist as a result of the forces acting on the belt during the tamping operation. If the tamper is rigidly fixed to the belt, then the twisting of the belt can cause binding between the bushings and the rod.

Embodiments of the disclosure provide an improved connection between the tamper and the belt that lessens or eliminates binding between the bushings and the stationary rod.

An embodiment of the disclosure may include a sheet stack aligning mechanism for a print job finishing machine. The mechanism can include a first belt driven in a reciprocating motion in a first direction and a second direction opposite to the first direction; a first stationary rod having a longitudinal direction and configured to be stationary relative to a body of the print job finishing machine; a first sheet stack alignment tamper that is configured to tamp a stack of sheets of media into alignment; and a first belt clamp. The first belt clamp has a first main body attached to the first sheet stack alignment tamper, a first pivot pin, a first belt attachment portion pivotably attached to the first main body by the first pivot pin, the first belt attachment portion being fixed to the first belt such that the first belt attachment portion does not move relative to the first belt, and a first bushing portion fixed to the first main body and slidably attached to the stationary rod. The first pivot pin permits the first belt attachment portion to follow a movement of the first belt in a direction non-parallel to the longitudinal direction of the stationary rod while the first main body of the first belt clamp moves only in the longitudinal direction of the stationary rod.

Another embodiment of the disclosure may include a print job finishing machine. The machine can include a body; a paper stacking area for holding a stack of sheets of media inside the body; and a sheet stack aligning mechanism inside the body. The mechanism has a first belt driven in a reciprocating motion in a first direction and a second direction opposite to the first direction; a first stationary rod having a longitudinal direction and being stationary relative to the body of the print job finishing machine; a first sheet stack alignment tamper that is configured to tamp the stack of sheets of media into alignment; and a first belt clamp. The first belt clamp has a first main body attached to the first sheet stack alignment tamper, a first pivot pin, a first belt attachment portion pivotably attached to the first main body by the first pivot pin, the first belt attachment portion being fixed to the first belt such that the first belt attachment portion does not move relative to the first belt, and a first bushing portion fixed to the first main body and slidably attached to the stationary rod. The first pivot pin permits the first belt attachment portion to follow a movement of the first belt in a direction non-parallel to the longitudinal direction of the stationary rod while the first main body of the first belt clamp moves only in the longitudinal direction of the stationary rod.

Some embodiments also include a second belt driven in a reciprocating motion in the first direction and the second direction; a second sheet stack alignment tamper that is configured to tamp the stack of sheets of media into alignment; and a second belt clamp. The second belt clamp has a second main body attached to the second sheet stack alignment tamper, a second pivot pin, a second belt attachment portion pivotably attached to the second main body by the second pivot pin, the second belt attachment portion being fixed to the second belt such that the second belt attachment portion does not move relative to the second belt, and a second bushing portion fixed to the second main body and slidably attached to the stationary rod. The second pivot pin permits the second belt attachment portion to follow a movement of the second belt in a direction non-parallel to the longitudinal direction of the stationary rod while the second main body of the second belt clamp moves only in the longitudinal direction of the stationary rod.

DETAILED DESCRIPTION

The disclosed embodiments may include a sheet stack aligning mechanism for a print job finishing machine. The mechanism can include a first belt driven in a reciprocating motion in a first direction and a second direction opposite to the first direction; a first stationary rod having a longitudinal direction and configured to be stationary relative to a body of the print job finishing machine; a first sheet stack alignment tamper that is configured to tamp a stack of sheets of media into alignment; and a first belt clamp. The first belt clamp has a first main body attached to the first sheet stack alignment tamper, a first pivot pin, a first belt attachment portion pivotably attached to the first main body by the first pivot pin, the first belt attachment portion being fixed to the first belt such that the first belt attachment portion does not move relative to the first belt, and a first bushing portion fixed to the first main body and slidably attached to the stationary rod. The first pivot pin permits the first belt attachment portion to follow a movement of the first belt in a direction non-parallel to the longitudinal direction of the stationary rod while the first main body of the first belt clamp moves only in the longitudinal direction of the stationary rod.

Some embodiments also provide a second belt driven in a reciprocating motion in the first direction and the second direction; a second sheet stack alignment tamper that is configured to tamp the stack of sheets of media into alignment; and a second belt clamp. The second belt clamp has a second main body attached to the second sheet stack alignment tamper, a second pivot pin, a second belt attachment portion pivotably attached to the second main body by the second pivot pin, the second belt attachment portion being fixed to the second belt such that the second belt attachment portion does not move relative to the second belt, and a second bushing portion fixed to the second main body and slidably attached to the stationary rod. The second pivot pin permits the second belt attachment portion to follow a movement of the second belt in a direction non-parallel to the longitudinal direction of the stationary rod while the second main body of the second belt clamp moves only in the longitudinal direction of the stationary rod.

Figure 1:
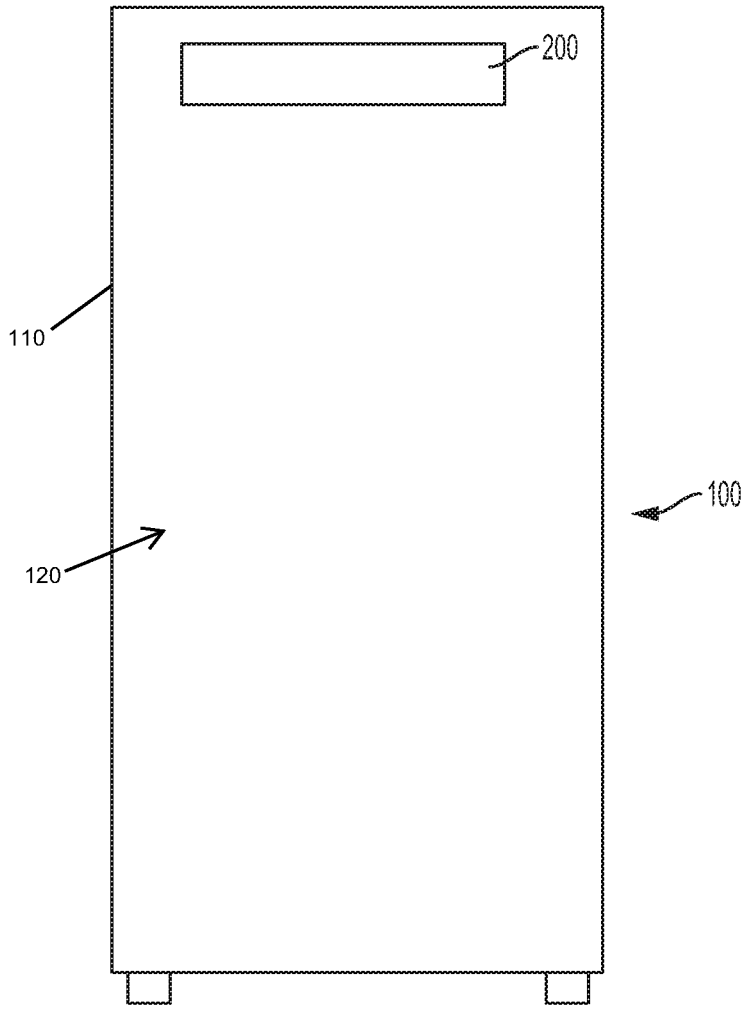
FIG. 1 is a schematic view of finisher in accordance with embodiments of the disclosure.

Some printing/copying systems include a finisher that performs one or more finishing operations such as, for example, stapling or other binding. Some of these finishers have an alignment function that aligns a stack of sheets of media before stapling or other binding. FIG. 1 shows a finishing machine or finisher 100 having a sheet stack aligning mechanism 200, a body 110, and a paper stacking area 120 for holding a stack of sheets of media inside the body 110. Alignment mechanisms can use one or more tampers to tamp the stack into alignment. Such a tamper can be attached to a belt that reciprocates to bring the tamper into contact with the stack. The tamper can also be slidably attached by way of bushings to a stationary rod such that movement of the tamper is constrained to a linear movement as the belt moves a tamper body to which the tamper is attached. The belt can twist as a result of the forces acting on the belt during the tamping operation. If the tamper is rigidly fixed to the belt, then the twisting of the belt can cause binding between the bushings and the rod.

Figure 2:
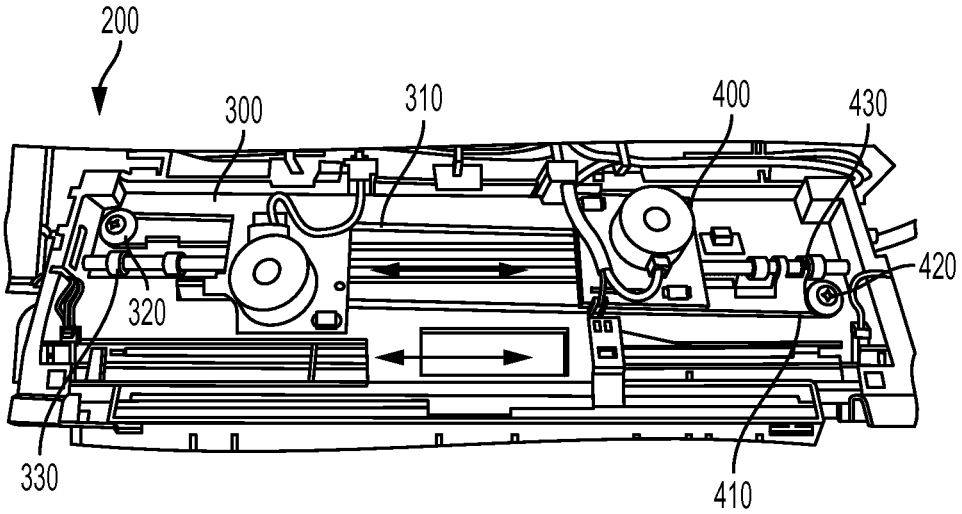
FIG. 2 shows an example of a paper stack alignment portion of a finisher.

FIG. 2 shows an example of an alignment mechanism 200 that has two belt driven tampers that tamp a stack of sheets into alignment. A first one of the mechanisms (first sheet stack alignment tamper) 300 has a tamper that extends below the mechanism shown in FIG. 2 and is attached to a carriage 330. Carriage 330 is attached to a belt 310 that runs around a pulley 320. As belt 300 is driven in a reciprocating motion, the tamper is pushed into contact (and removed from contact) with the stack of sheets. A second one of the mechanisms (second sheet stack alignment tamper) 400 has a tamper that extends below the mechanism shown in FIG. 2 and is attached to a carriage 430. Carriage 430 is attached to a belt 410 that runs around a pulley 420. As belt 410 is driven in a reciprocating motion, the tamper is pushed into contact (and removed from contact) with the stack of sheets. As the stack of sheets is pressed between the two tampers, the sheets in the stack are brought into alignment with each other. While the example shown in FIG. 2 has two tampers and associated mechanisms, other examples have only one tamper or more than two tampers.

Figure 3:
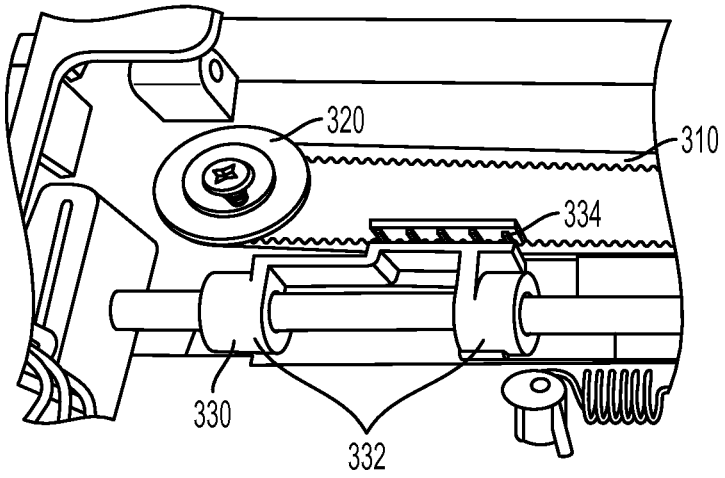
FIG. 3 shows an example of belt holder.

FIG. 3 is a closer view of part of the mechanism 300. FIG. 3 shows that carriage 330 has two bushings 332 that are mounted to a stationary rod such that the bushings and carriage 330 can slide along the rod. Carriage 330 has a belt attachment portion 334 that securely holds belt 310 such that carriage 330 moves with any movement of belt 310.

Embodiments of the disclosure recognize that belt 310 can twist during movement due to the forces exerted on belt 310. This twisting is transferred to carriage 330 through belt attachment portion 334 and can exert forces on bushings 332 that can cause bushings 332 to bind on the stationary rod. These forces exerted on bushings 332 can result in increased frictional forces and increased noise.

Figure 4:
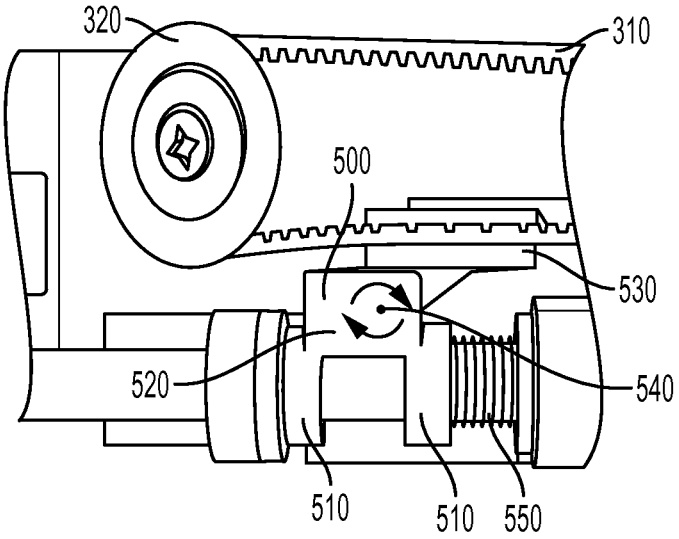
FIG. 4 shows an example of a belt holder in accordance with embodiments of the disclosure.

FIG. 4 shows an example of an embodiment of the disclosure that reduces or prevents the transmission of the above described twisting forces to the bushing/rod interface. In FIG. 4, carriage 500 has a main body 520 that is fixed to, in this example, two bushings 510 that slid along the stationary rod. A belt attachment portion 530 securely holds belt 310 such that belt attachment portion 530 moves with any movement of belt 310. However, belt attachment portion 530 is pivotably attached to main body 520 by a pivot pin 540 such that belt attachment portion 530 can pivot relative to main body 520 while still transferring transitory motion from belt 310 to main body 520. This pivoting motion reduces or eliminates the binding forces that can exist in the example shown in FIGS. 2 and 3.

Figure 5:
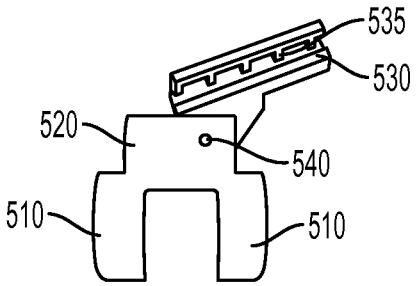
FIG. 5 shows an example of a belt holder in accordance with embodiments of the disclosure.

FIG. 5 shows carriage 500 removed from the alignment mechanism for clarity. FIG. 5 shows belt attachment portion 530 in a pivoted upward position as opposed to the more parallel position shown in FIG. 4. Also shown in FIG. 5 are protrusions 535 that assist in gripping belt 310.

Figure 6:
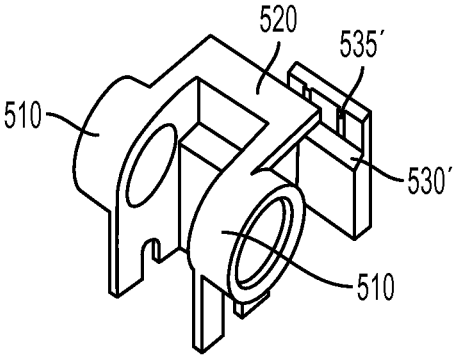
FIG. 6 shows an example of a belt holder in accordance with embodiments of the disclosure.

FIG. 6 shows a slightly different version of carriage 500. In this example, belt attachment portion 530' sits down inside of main body 520 when in the parallel position and has a shorter section that includes protrusions 535'.

Figure 7:
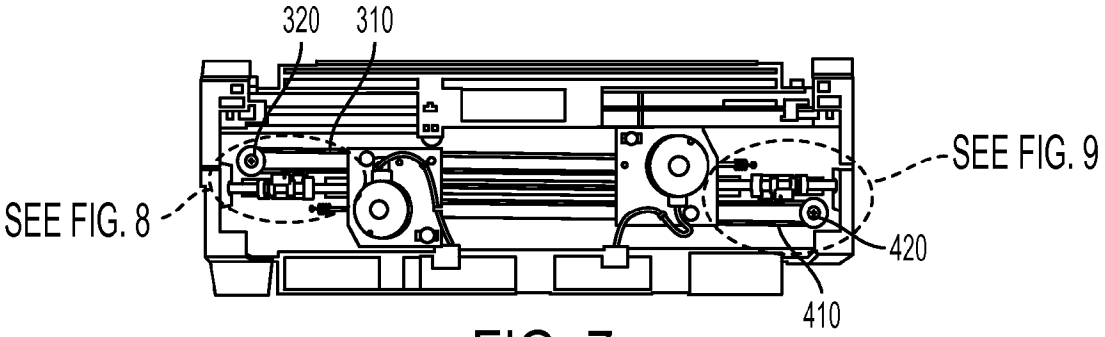
FIG. 7 shows an example of a paper stack alignment portion of a finisher in accordance with embodiments of the disclosure.
Figure 9:
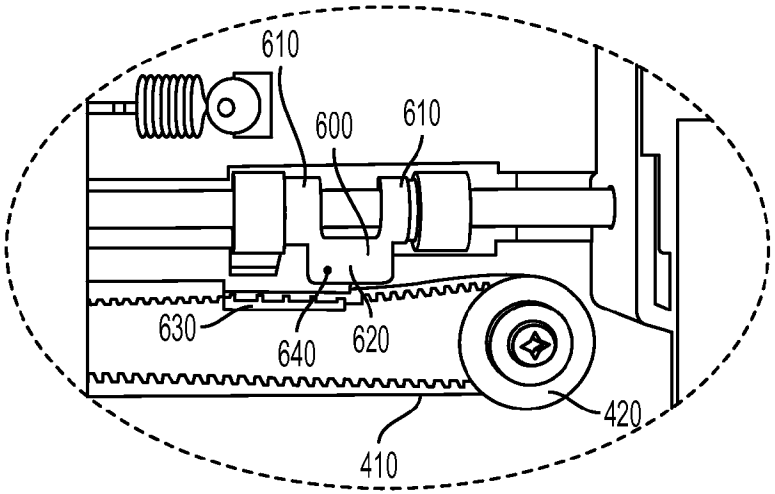
FIG. 9 shows an example of a belt holder in accordance with embodiments of the disclosure.
Figure 8:
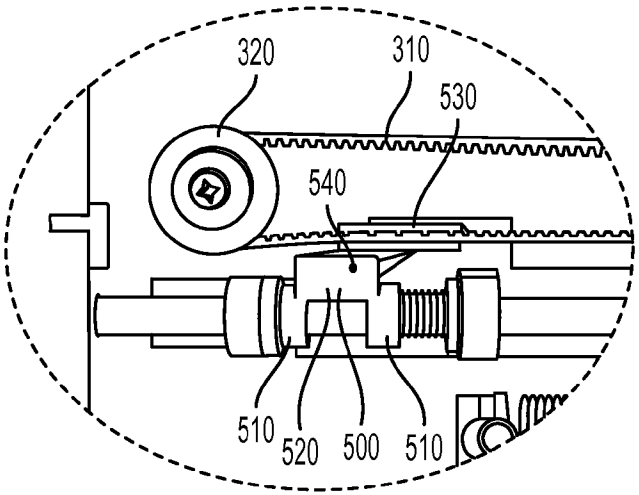
FIG. 8 shows an example of a belt holder in accordance with embodiments of the disclosure.

FIG. 7 shows an alignment mechanism using two of the carriages shown in FIG. 4. FIGS. 8 and 9 are closer views of the two carriages and their interactions with belts 310 and 410. In FIG. 8 carriage 500 has two bushings 510 that slidingly mount the main body 520 of carriage 500 to the stationary rod. The pivoting attachment of belt attachment portion 530 to main body 520 by pivot pin 540 is clearly shown. Also shown in FIG. 8 is a spring that cushions the tamping action of that tamper that is actuated by main body 520. FIG. 9 shows that second carriage 600 has two bushings 610 that slidably mount the main body 620 of carriage 600 to the stationary rod. The pivoting attachment of belt attachment portion 630 to main body 620 by pivot pin 640 is clearly shown. In this example, both carriages are mounted to the same stationary rod.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A sheet stack aligning mechanism for a print job finishing machine, the mechanism comprising:

a first belt driven in a reciprocating motion in a first direction and a second direction opposite to the first direction;

a first stationary rod having a longitudinal direction and configured to be stationary relative to a body of the print job finishing machine;

a first sheet stack alignment tamper that is configured to tamp a stack of sheets of media into alignment; and a first belt clamp having a first main body attached to the first sheet stack alignment tamper, a first pivot pin, a first belt attachment portion pivotably attached to the first main body by the first pivot pin, the first belt attachment portion being fixed to the first belt such that the first belt attachment portion does not move relative to the first belt, and a first bushing portion fixed to the first main body and slidably attached to the stationary rod, wherein the first pivot pin permits the first belt attachment portion to follow a movement of the first belt in a direction non-parallel to the longitudinal direction of the stationary rod while the first main body of the first belt clamp moves only in the longitudinal direction of the stationary rod.

2. The mechanism of claim 1, wherein the first direction is substantially parallel to the longitudinal direction of the stationary rod.

3. The mechanism of claim 1, further comprising:

a second belt driven in a reciprocating motion in the first direction and the second direction;

a second sheet stack alignment tamper that is configured to tamp the stack of sheets of media into alignment; and a second belt clamp having a second main body attached to the second sheet stack alignment tamper, a second pivot pin, a second belt attachment portion pivotably attached to the second main body by the second pivot pin, the second belt attachment portion being fixed to the second belt such that the second belt attachment portion does not move relative to the second belt, and a second bushing portion fixed to the second main body and slidably attached to the stationary rod, wherein the second pivot pin permits the second belt attachment portion to follow a movement of the second belt in a direction non-parallel to the longitudinal direction of the stationary rod while the second main body of the second belt clamp moves only in the longitudinal direction of the stationary rod.

4. The mechanism of claim 3, wherein the first direction is substantially parallel to the longitudinal direction of the stationary rod.

5. The mechanism of claim 4, wherein the first belt and the second belt are located on opposite sides of the stationary rod.

6. The mechanism of claim 5, wherein the first belt and the second belt are configured to move the first main body and the second main body toward each other during a tamping/alignment operation.

7. The mechanism of claim 3, wherein the first belt and the second belt are located on opposite sides of the stationary rod.

8. The mechanism of claim 7, wherein the first belt and the second belt are configured to move the first main body and the second main body toward each other during a tamping/alignment operation.

9. A print job finishing machine, comprising:

a body;

a paper stacking area for holding a stack of sheets of media inside the body; and a sheet stack aligning mechanism inside the body, the mechanism having a first belt driven in a reciprocating motion in a first direction and a second direction opposite to the first direction;

a first stationary rod having a longitudinal direction and being stationary relative to the body of the print job finishing machine;

a first sheet stack alignment tamper that is configured to tamp the stack of sheets of media into alignment; and a first belt clamp having a first main body attached to the first sheet stack alignment tamper, a first pivot pin, a first belt attachment portion pivotably attached to the first main body by the first pivot pin, the first belt attachment portion being fixed to the first belt such that the first belt attachment portion does not move relative to the first belt, and a first bushing portion fixed to the first main body and slidably attached to the stationary rod, wherein the first pivot pin permits the first belt attachment portion to follow a movement of the first belt in a direction non-parallel to the longitudinal direction of the stationary rod while the first main body of the first belt clamp moves only in the longitudinal direction of the stationary rod.

10. The machine of claim 9, wherein the first direction is substantially parallel to the longitudinal direction of the stationary rod.

11. The machine of claim 9, further comprising:

a second belt driven in a reciprocating motion in the first direction and the second direction;

a second sheet stack alignment tamper that is configured to tamp the stack of sheets of media into alignment; and a second belt clamp having a second main body attached to the second sheet stack alignment tamper, a second pivot pin, a second belt attachment portion pivotably attached to the second main body by the second pivot pin, the second belt attachment portion being fixed to the second belt such that the second belt attachment portion does not move relative to the second belt, and a second bushing portion fixed to the second main body and slidably attached to the stationary rod, wherein the second pivot pin permits the second belt attachment portion to follow a movement of the second belt in a direction non-parallel to the longitudinal direction of the stationary rod while the second main body of the second belt clamp moves only in the longitudinal direction of the stationary rod.

12. The machine of claim 11, wherein the first direction is substantially parallel to the longitudinal direction of the stationary rod.

13. The machine of claim 12, wherein the first belt and the second belt are located on opposite sides of the stationary rod.

14. The machine of claim 13, wherein the first belt and the second belt move the first main body and the second main body toward each other during a tamping/alignment operation.

15. The machine of claim 11, wherein the first belt and the second belt are located on opposite sides of the stationary rod.

16. The machine of claim 15, wherein the first belt and the second belt move the first main body and the second main body toward each other during a tamping/alignment operation.

* * * * *